US008042287B2

(12) United States Patent
Reinhardt et al.

(10) Patent No.: US 8,042,287 B2
(45) Date of Patent: Oct. 25, 2011

(54) INSOLE COMPRISING A CURVE SUPPORT

(75) Inventors: Holger Reinhardt, Kempen (DE); Günter Grabbe, Extertal (DE)

(73) Assignee: Bauerfeind AG, Zeulenroda (DE)

( * ) Notice: Subject to any disclaimer, the term of this patent is extended or adjusted under 35 U.S.C. 154(b) by 624 days.

(21) Appl. No.: 12/086,532

(22) PCT Filed: Dec. 4, 2006

(86) PCT No.: PCT/EP2006/011619

§ 371 (c)(1),
(2), (4) Date: Jul. 18, 2008

(87) PCT Pub. No.: WO2007/073830

PCT Pub. Date: Jul. 5, 2007

(65) Prior Publication Data

US 2010/0218398 A1 Sep. 2, 2010

(30) Foreign Application Priority Data

Dec. 16, 2005 (DE) ..... 20 2005 019 691 U

(51) Int. Cl.
*A43B 13/38* (2006.01)

(52) U.S. Cl. ..... 36/43; 36/179

(58) Field of Classification Search ..... 36/43, 179, 36/44, 27, 151, 158, 168
See application file for complete search history.

(56) References Cited

U.S. PATENT DOCUMENTS

| | | | | |
|---|---|---|---|---|
| 1,934,591 | A | 11/1933 | Churchill et al. | |
| 2,129,424 | A * | 9/1938 | Jay | 36/76 R |
| 3,999,558 | A | 12/1976 | Barnwell et al. | |
| 4,441,499 | A | 4/1984 | Comparetto et al. | |
| 4,571,857 | A | 2/1986 | Castellanos | |
| 5,311,680 | A * | 5/1994 | Comparetto | 36/154 |
| 5,394,626 | A | 3/1995 | Brown | |
| 5,647,145 | A * | 7/1997 | Russell et al. | 36/28 |
| 5,675,914 | A * | 10/1997 | Cintron | 36/3 B |
| 7,421,808 | B2 * | 9/2008 | Baier et al. | 36/107 |
| 2005/0283997 | A1 * | 12/2005 | Wang | 36/3 B |
| 2006/0137216 | A1 | 6/2006 | Ahlbaumer | |
| 2006/0254087 | A1 | 11/2006 | Fechter | |
| 2007/0011908 | A1 * | 1/2007 | Huang et al. | 36/3 B |

FOREIGN PATENT DOCUMENTS

| | | | |
|---|---|---|---|
| DE | 1 751 131 | | 8/1957 |
| DE | 17 58 028 | U | 12/1957 |
| DE | 39 42 094 | A1 | 6/1991 |
| DE | 196 01 344 | C2 | 8/1996 |
| DE | 296 19 584 | U1 | 4/1997 |
| DE | 103 14 606 | A1 | 10/2004 |
| EP | 0 224 613 | A1 | 6/1987 |
| FR | 2 610 485 | A | 8/1988 |
| JP | 2001-269201 | A | 10/2001 |
| WO | WO-2005/025358 | A2 | 3/2005 |

* cited by examiner

*Primary Examiner* — Ted Kavanaugh
(74) *Attorney, Agent, or Firm* — Birch, Stewart, Kolasch & Birch, LLP

(57) ABSTRACT

The invention relates to a plastic insole comprising a curve support for the metatarsus. Provided in the region of the greatest height of the curve support on the underside of the insole are a plurality of longitudinally extending stiffening ribs as well as grooves, said grooves extending from the toe region in the direction of the heel as far as the metatarsal region and so curving round in the metatarsal region to the lateral side of the insole and terminating in said region that extending between the grooves are spring strips issuing from each of the toes, wherein material can be removed from the spring strips and stiffening ribs in order individually to adapt the thickness thereof.

3 Claims, 1 Drawing Sheet

INSOLE COMPRISING A CURVE SUPPORT

The invention relates to a plastic insole comprising a curve support for the metatarsus.

Such an insole is described and presented in U.S. Pat. No. 4,441,499. Said insole consists of strips extending in the longitudinal direction of the foot, said strips being cut out of a strap by parallel cuts, so that the strap is weakened and therefore has greater elasticity. The resulting straight strips on the foot side extend from the region behind the toes to behind the metatarsus and thereby support only the metatarsus. An improvement on said design is disclosed in U.S. Pat. No. 5,311,680, in which the individual straight strips are separated from each other, starting from the toe region, by parallel cuts which terminate in a region approximately at the highest curvature and lie on a line extending at approximately 45° to the longitudinal direction of the foot. Said cuts can be interconnected by bridges for stiffening; however, such bridges have an adverse effect on the evenness of the insole.

The object of the invention is to create a plastic insole in which the design of the curve support for the metatarsus conforms to the variation in the pressure of the foot on the insole and which is individually adaptable, with respect to its supporting function, to the curvature of the wearer's foot. The object of the invention is achieved in that provided in the region of the greatest height of the curve support on the underside of the insole are a plurality of longitudinally extending stiffening ribs as well as grooves, said grooves extending from the toe region in the direction of the heel as far as the metatarsus and so curving round in the metatarsal region to the lateral side of the insole and terminating in said region that extending between the grooves are spring strips issuing from each of the toes, wherein material can be removed from the spring strips and stiffening ribs in order individually to adapt the thickness thereof.

In the present insole, both the stiffening ribs and also the spring strips serve to support the foot, and material can be removed from said stiffening ribs and spring strips in order individually to adapt them to the shape of the wearer's foot, with the result that, where more material is removed from the relevant location, the foot will press with correspondingly less pressure on the curve support. In this connection, it is possible in known manner, using today's conventional orthopaedic measuring instruments for determining the pressure on the sole of the foot, divided into closely adjacent regions, to employ individual pressure sensors in order accurately to measure the pressure distribution, which information can subsequently be used to remove the requisite amount of material from the stiffening ribs and/or spring strips, wherein the grooves, which curve round to the lateral side of the insole, ensure that there are provided suitably curved spring strips that conform to the normal loading of the foot during ambulation, as presented, for example, in FIG. 7b of U.S. Pat. No. 5,394,626.

For the orthopaedic specialist, the curved spring strips and stiffening ribs represent parts of the insole that are easy to work on in order to adapt the insole to the particular shape of the wearer's foot, it being possible for the thickness of said spring strips and stiffening ribs to be reduced in simple manner through the removal of material, which can be accomplished, for example, by grinding using a hand grinder. For the orthopaedic specialist, therefore, the thus designed insole constitutes an easily adaptable design that can be quickly and easily produced once the pressure values across the foot have been measured in the aforementioned manner.

In order to make the insole comfortable for the wearer also outside of the support region thereof, it is advantageous, for the support region, to employ a hard plastic in the heel and toe regions, whereas a soft plastic is used to fill out those regions left open by the curve support and additionally bridge the spring strips, which spring strips are separated in the toe region. The thus softened locations in the insole make the insole comfortable for use by the wearer, the holding-together of the spring strips in the toe region resulting in an equalization of pressure across the toe region. The soft plastic can additionally be used as an overlay over the curve support, this being of further benefit with regard to the comfort of use of the insole.

An illustrative example of the invention is presented in the drawings, in which.

Figure 1:
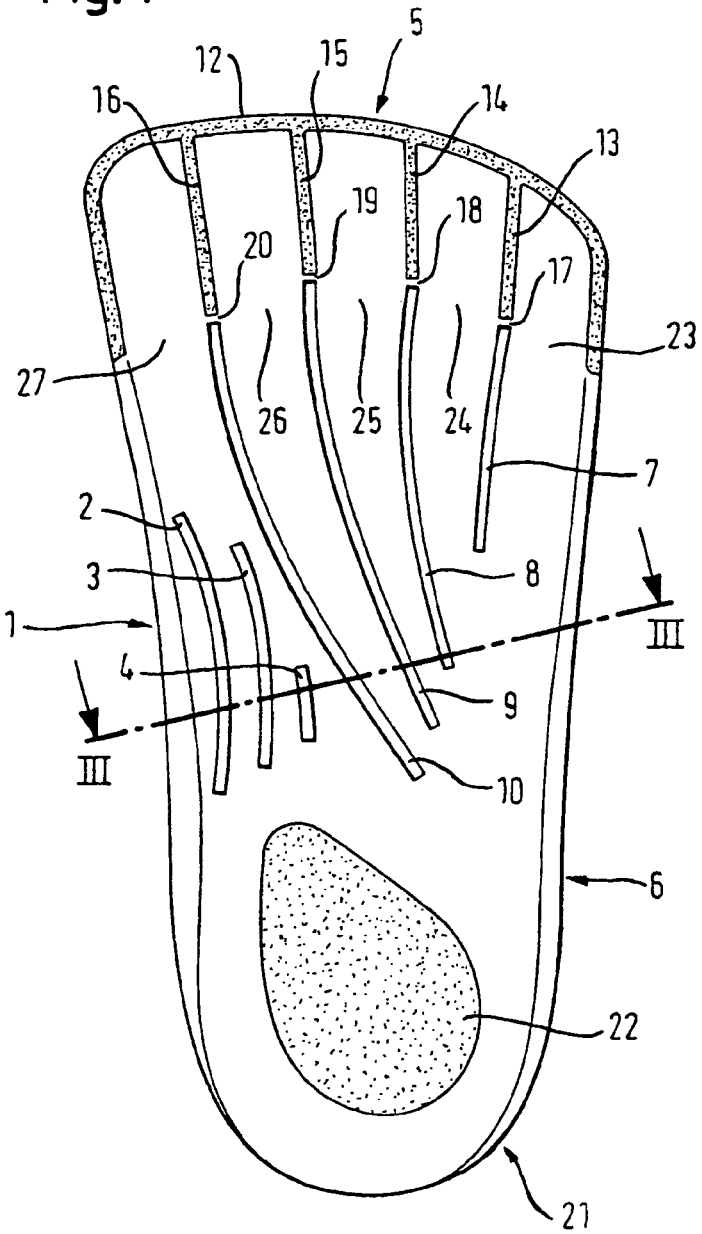
FIG. 1 shows a top plan view of the non-foot side of an insole for the left foot.
Figure 2:
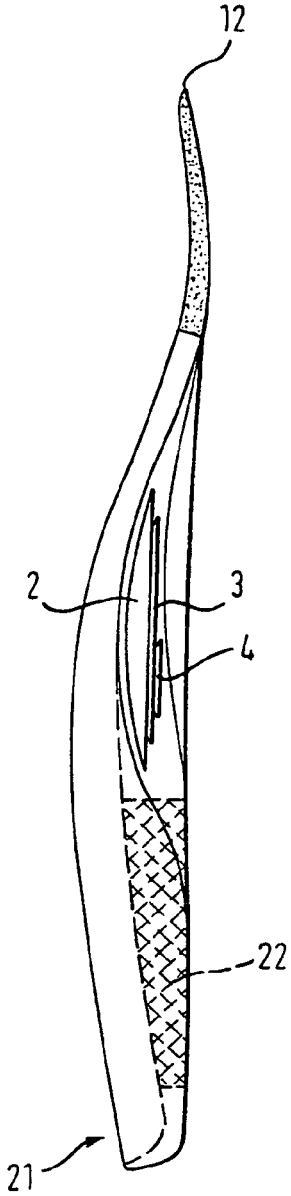
FIG. 2 shows a side elevation view of the insole from FIG. 1.

FIG. 1 presents the insole in a plan view of the non-foot side thereof, which side is entirely of plastic and is provided in the region of its curve support 1 with three stiffening ribs 2, 3 and 4, which stiffening ribs 2, 3 and 4 are approximately a few millimetres in height and provide the plastic material with a support for the metatarsus in the region of the curve support 1 when the insole is under load.

The sectional view along line III-III from FIG. 1 clearly shows how the stiffening ribs 2, 3 and 4 are clearly raised from the region of the curve support 1.

Figure 3:
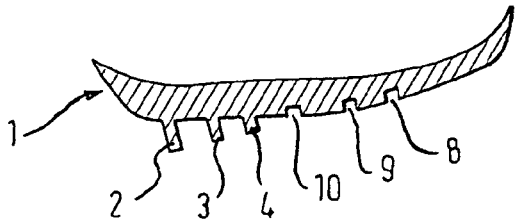
FIG. 3 shows a section along line III-III from FIG. 1.

The insole further comprises grooves 7, 8, 9 and 10, said grooves 7, 8, 9 and 10 extending from the toe region 5 towards the metatarsal region 6, extending into the toe region 5 and projecting beyond the metatarsal region 6, where they pass through section line III-III from FIG. 1. Of said grooves, the sectional representation in FIG. 3 shows grooves 8, 9 and 10. The grooves 7, 8, 9 and 10 continue as far as the front edge 12 of the insole in the form of slits 13, 14, 15 and 16, which slits 13, 14, 15 and 16 are, in this case, filled out with a soft plastic and transition via bridges 17, 18, 19 and 20 into grooves 7, 8, 9 and 10. The soft plastic material in slits 13, 14, 15 and 16 is continued into the edge 12 of the insole, where it forms a soft termination, there extending between the slits 13, 14, 15 and 16 the slightly pivoting parts of the spring strips 23, 24, 25, 26 and 27.

In the heel region 21 of the insole, said insole is provided with the heel cushion 22, which is likewise of soft plastic material.

As is clearly shown in FIG. 1, the grooves 7, 8, 9 and 10, slits 13, 14, 15 and 16 and edge 12 of the insole combine to form the essentially curved spring strips 23, 24, 25, 26 and 27, the curve being such as to conform to the normal loading of the foot during ambulation. Consequently, the insole is optimally adapted to the foot, especially during ambulation. For use of the insole, the depth of the aforementioned grooves can be adapted to the wearer's foot by removing material from the aforementioned spring strips 23, 24, 25, 26 and 27 in order to reduce the thickness thereof, this being most easily accomplished by grinding, whereupon the depth of the grooves is suitably reduced, this modifying the springiness of the aforementioned spring strips to afford greater elasticity. The stiffening ribs 2, 3 and 4, too, can be adapted to suit the particular shape of the subsequent wearer's foot, namely through the removal of material to reduce the thickness thereof, i.e. in this case, to reduce the height thereof in relation to the base of the insole, whereby the highest curvature of the insole can be suitably reduced if so required by the shape of the subsequent wearer's foot. Once again, such removal of material to reduce the height is advantageously accomplished by grinding.

Consequently, the hereinbefore described insole is optimally adaptable to the shape of the subsequent wearer's foot, such adaptation being simple to perform, namely by suitably removing plastic material from the insole by grinding.

Of course, the design of the insole for the other foot is a mirror image of that of the hereinbefore described insole.

What is claimed is:

1. Plastic insole comprising:

a curve support (1) for the metatarsus, the curve support (1) including:

a toe region (5), a metatarsal region (6), a heel (21)

a plurality of longitudinally extending stiffening ribs (2, 3, 4) and a plurality of grooves (7, 8, 9, 10) formed on a region of greatest height of the curve support (1) on an underside of the insole, said grooves (7, 8, 9, 10) extending from the toe region (5) in a direction of the heel (21), curving toward a lateral side of the metatarsal region (6) of the curve support (1), and terminating in the metatarsal region (6) of the curve support (1), and a spring strip (23, 24, 25, 26, 27) issuing from each toe of the toe region (5), wherein material can be removed from the spring strips (23, 24, 25, 26, 27) and stiffening ribs (2, 3, 4) in order individually to adapt the thickness thereof.

2. The insole according to claim 1, wherein the curve support (1) is of a hard plastic and, in the heel (21) and the toe (5) regions, a soft plastic fills out regions left open by the curve support (1), wherein, in the toe region (5), the soft plastic bridges the spring strips (23, 24, 25, 26, 27), said spring strips (23, 24, 25, 26, 27) being separated in said toe region (5) by slits (13, 14, 15, 16).

3. The insole according to claim 2, wherein the soft plastic, as an overlay over the curve support (1), at least partially covers said curve support (1).

* * * * *